US009120603B2

(12) United States Patent
Sekse

(10) Patent No.: US 9,120,603 B2
(45) Date of Patent: Sep. 1, 2015

(54) DEVICE FOR SLIDING LID ON A DRILLING MUD CONTAINER

(75) Inventor: Jan Sekse, Sola (NO)

(73) Assignee: Consult Supply AS, Tananger (NO)

( * ) Notice: Subject to any disclaimer, the term of this patent is extended or adjusted under 35 U.S.C. 154(b) by 57 days.

(21) Appl. No.: 13/883,458

(22) PCT Filed: Nov. 4, 2011

(86) PCT No.: PCT/NO2011/000312

§ 371 (c)(1),
(2), (4) Date: May 3, 2013

(87) PCT Pub. No.: WO2012/060717

PCT Pub. Date: May 10, 2012

(65) Prior Publication Data

US 2013/0221016 A1 Aug. 29, 2013

(30) Foreign Application Priority Data

Nov. 6, 2010 (NO) ..... 20101563

(51) Int. Cl.

| | |
|---|---|
| ***B65D 43/20*** | (2006.01) |
| ***B65D 90/58*** | (2006.01) |
| ***B65D 90/62*** | (2006.01) |
| ***B65D 90/66*** | (2006.01) |
| ***B65D 45/00*** | (2006.01) |
| ***B65F 1/14*** | (2006.01) |

(52) U.S. Cl.

CPC ..... *B65D 43/20* (2013.01); *B65D 45/00* (2013.01); *B65D 90/587* (2013.01); *B65D 90/623* (2013.01); *B65D 90/66* (2013.01); *B65F 1/1623* (2013.01); *B65D 2588/125* (2013.01); *B65D 2590/547* (2013.01); *B65D 2590/664* (2013.01)

(58) Field of Classification Search

CPC ..... B65D 35/42; B65D 43/20; B65D 90/587; B65D 90/623; B65D 2590/547; B65D 2590/664; B65F 1/16; B65F 1/1607; B65F 1/1623; B65F 1/1646

USPC ..... 220/211, 254.1, 254.3, 254.9, 255, 220/256.1, 259.1, 259.5, 263, 810, 811, 220/812, 813, 833

See application file for complete search history.

(56) References Cited

U.S. PATENT DOCUMENTS

| | | | | |
|---|---|---|---|---|
| 2,989,008 | A | 6/1961 | Lindstrom | |
| 4,301,741 | A * | 11/1981 | Chierici | 105/282.3 |
| 4,467,932 | A * | 8/1984 | Dabich | 220/484 |
| 7,108,148 | B2 * | 9/2006 | Lu | 220/263 |
| 7,673,769 | B2 * | 3/2010 | McRorie, III | 220/735 |
| 2003/0192900 | A1 | 10/2003 | Petzitillo et al. | |
| 2007/0210079 | A1 | 9/2007 | Oksnevad | |

* cited by examiner

*Primary Examiner* — Jeffrey Allen
*Assistant Examiner* — Madison L Poos
(74) *Attorney, Agent, or Firm* — Patents+TMS, P.C.

(57) ABSTRACT

A device in a drilling-mud container (1) including bulkheads of plates (4, 5) provided with vertical and horizontal profiles (2, 3) forming a frame (2), the drilling-mud container (1) being provided with at least one sliding lid (8) which is arranged to be displaced in a sliding track (22) by means of at least one opening mechanism (15) independently of the position of a second hatch (7), wherein a toothed wheel (19), which is rotatably arranged in the drilling-mud container (1), is in engagement with a pitch rack (21) arranged in the sliding lid (8), and the pitch rack (21) is provided with an end portion (21*a*) which is inclined in the direction of the toothed wheel (19), the abutment of the end portion (21*a*) against the toothed wheel (19) causing the sliding lid (8) to be displaced in a vertical direction into sealing abutment against an abutment portion (22) on the drilling-mud container (1).

5 Claims, 2 Drawing Sheets

DEVICE FOR SLIDING LID ON A DRILLING MUD CONTAINER

A device for a drilling-mud container including bulkheads of plates provided with vertical and horizontal profiles forming a frame is described, characterized by the drilling-mud container being provided with at least one sliding lid which is arranged to be displaced in a sliding track by means of at least one opening mechanism independently of the position of a second hatch.

In what follows, conditions relating to filling and emptying a container holding a mass, typically drilling mud, in connection with oil and gas exploration drilling are described.

In oil drilling and equivalents thereto, liquids, typically drilling mud, completion fluid (brine), and slop fluid (mixture of drilling/completion fluid and water) are used, and it is important that they are handled properly and safely upon return to the surface.

Contaminated liquids are carried from the drilling device to a remote facility for further processing to properly clean the liquids and handle the separated waste.

For this, it is necessary to use waste containers which have to be tight so as not to get any emissions of said contaminated liquid during the transport to the processing facility for further treatment.

In offshore drilling operations, contaminated drilling mud in waste containers is carried by supply ships, and on shore the transport is by road vehicles or other vehicles, and it is important that pollution of the environment is avoided. The transport is often over long distances, and it is important to ensure that the waste containers are securely closed.

There are a number of waste containers for this purpose in the market. They often have in common that they are time-consuming in handling and do not meet the requirements for safe handling. This is particularly the case in connection with filling and emptying, in which an operator must operate a big and often heavy and difficult-to-handle hatch which closes the top of the waste container. This is carried out in all kinds of weather as the waste container is often handled outdoors, as for example on a drilling platform. Here, there is a great crushing hazard, and the operator must pay regard to a number of safety considerations in connection with operating the hatches.

Even though some of the existing waste containers are provided with more light-weight aluminium lids, these are often big and may involve risk.

From JP 9086591 A a container for transporting waste is known, in which a cover of cloth is secured at an open container top and is contractible and extendable by means of a bellows system, a fixed first wire being extended through openings arranged in the side portions of the cloth, along which the cloth may be moved. A second wire, which is connected to a cranking mechanism, is passed across sheaves and attached to an end portion of the cloth. By operating the crank, the cloth may be pulled over the open top of the container, closing it.

From US 2003/192900 A1 a container provided with a lid which is displaceable along a sliding track between a closed position and a position outside the opening of the container is known. The lid may be clamped into sealing abutment against the container by means of clamping devices arranged on the walls of the container.

The invention has for its object to remedy or reduce at least one of the drawbacks of the prior art, or at least provide a useful alternative to the prior art.

The object is achieved in accordance with the invention through the features which are specified in the description below and in the claims that follow.

The invention provides a sliding lid which is easy and safe to open. The lid exhibits approximately the same measurements as known lids (physical outer measurements). It is important that a sliding lid has a certain opening when open to facilitate the emptying process.

The sliding lid according to the invention exhibits simpler functionality and thereby greater safety. The invention fulfils the strict safety requirements placed on waste containers of this kind.

The invention will create great flexibility with respect to servicing and handling waste containers. On a waste container there are often at least two lids which should have the possibility of being opened. The invention has a first lid which is provided with an opening mechanism which may be positioned in the second one of the hatches. The opening mechanism and the first lid are not an obstacle to opening the second lid.

Further, the sliding lid is designed to be manufactured with a relatively low consumption of material.

The invention relates more specifically to a device in a drilling-mud container including bulkheads of plates provided with vertical and horizontal profiles forming a frame, the drilling-mud container being provided with at least one sliding lid which is arranged to be displaced in a sliding track by means of at least one opening mechanism independently of the position of a second hatch, characterized by a toothed wheel, which is rotatably arranged within the drilling-mud container and included in the opening mechanism, being in engagement with a pitch rack arranged in the sliding lid, and the pitch rack being provided with an end portion which is inclined in the direction of the toothed wheel, the abutment of the end portion against the toothed wheel causing the sliding lid to be displaced, during its displacement towards the closed position, in a vertical direction into sealing abutment against an abutment portion on the drilling-mud container.

The opening mechanism may be formed of a winch system which is connected by means of a drive chain to the toothed wheel which is rotatably arranged in the drilling-mud container and is in engagement with the pitch rack arranged in the sliding lid.

By locking engagement, a locking and lifting mechanism connected to the sliding lid may be arranged to displace the sliding lid into sealing abutment against the bulkhead and/or frame of the drilling-mud container.

The abutment portion may be a sliding rail surrounding a side edge of the sliding lid.

The winch system may be fixed within the drilling-mud container and is connectable to a shaft which is supported in the second hatch and is provided with a handle.

In what follows, a non-limiting example of a preferred embodiment is described, which is visualized in the accompanying drawings, in which.

Figure 1:
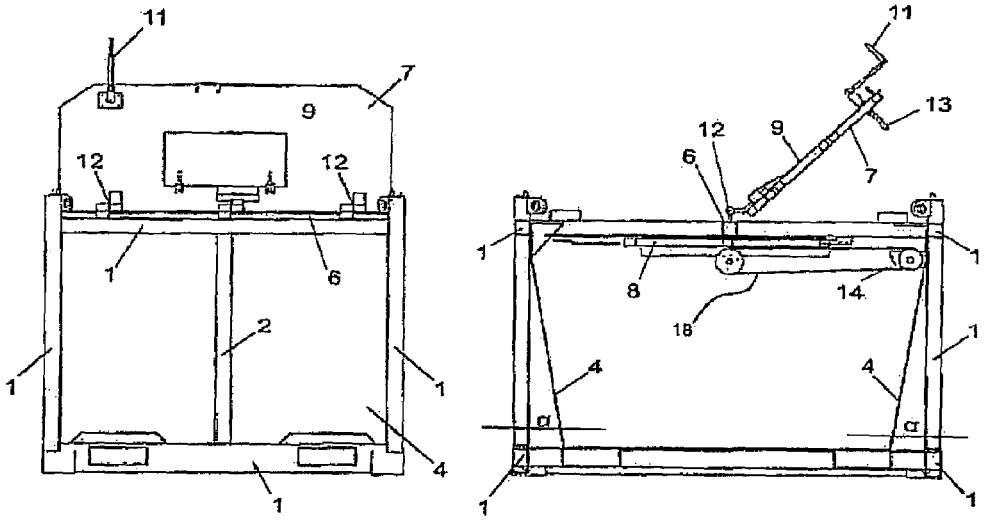
FIG. 1 shows front and side views of a non-dimensioned waste container in which a so-called service hatch is shown in an open position.
Figure 4:
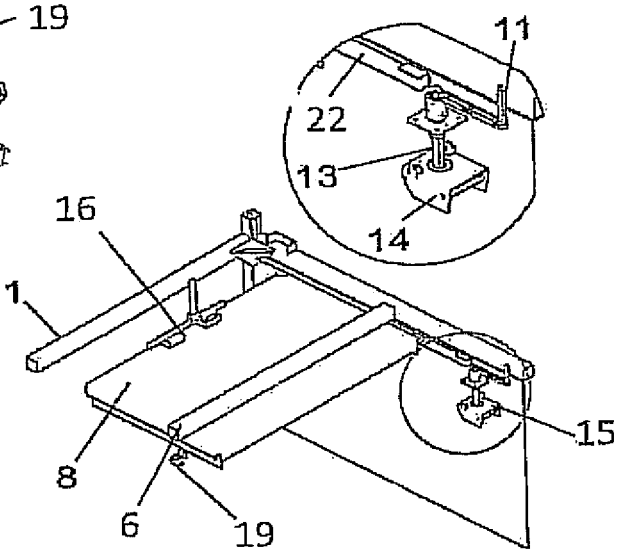
FIG. 4 shows, on a larger scale, details of the sliding lid.

In the drawings, the reference numeral 1 indicates a waste container which is provided with a frame 2, 3 and bulkheads 4, 5. The waste container 1 is provided with a hatch 7, also called a service hatch, provided with hinges 12 connected to a division profile 6. The service hatch 7, which is often opened in connection with maintenance, is shown here with a filling hatch 9. The filling hatch 9 may work as an opening in connection with pumping drilling mud into the waste container 1. FIG. 1 shows the service hatch 7 in the open position and provided with a handle 11 which is connected to the shaft 13 supported in the service hatch 7, forming elements in an opening mechanism 15 (see FIG. 4 in particular). The service hatch (7) can be opened and closed without this affecting a winch system which is arranged in the upper portion of the waste container 1.

Figure 5:
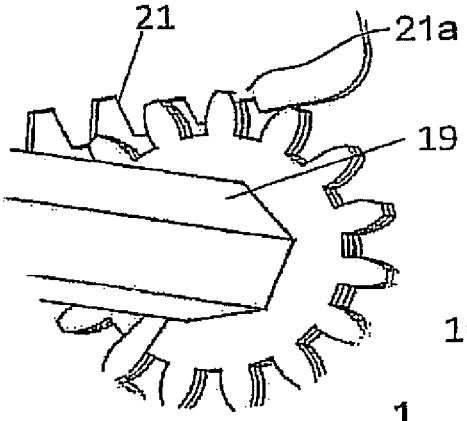
FIG. 5 shows, on a still larger scale, a detail in the sliding lid.

The winch system 14 is connected by way of a drive chain 18 to two toothed wheels 19 supported in the frame 2. The toothed wheels 19 are in engagement with respective pitch racks 21 (see FIG. 5) arranged along the side edges of the sliding lid 8. In an end portion 21*a* facing the toothed wheels 19, the pitch rack 21 is provided with a toothed bottom surface portion which is inclined in the direction of the respective toothed wheel 19. When the lid 8 is displaced towards its closed position, the inclined portion 21*a* of the pitch rack 21 will contribute to the sliding hatch being lifted into sealing abutment against an abutment portion 22 inside a sliding rail arranged in the frame 2 (see FIG. 4 in particular).

Figure 2:
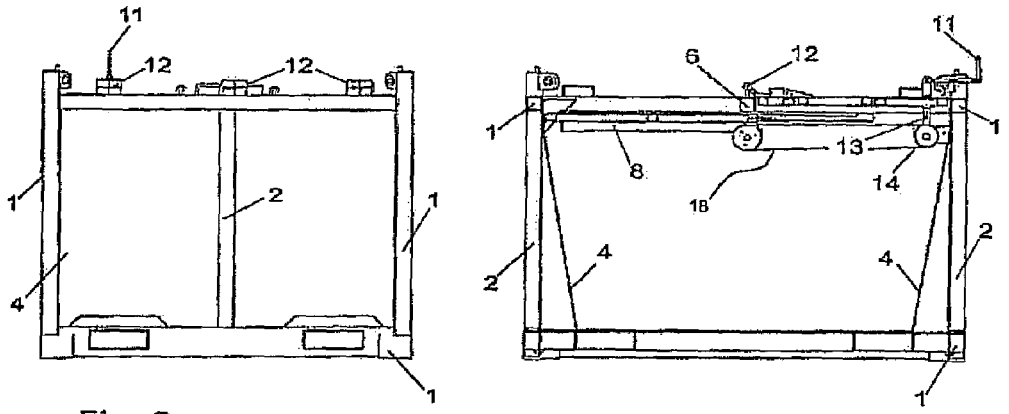
FIG. 2 shows front and side views of the waste container in which the so-called service hatch is in a closed position.
Figure 3:
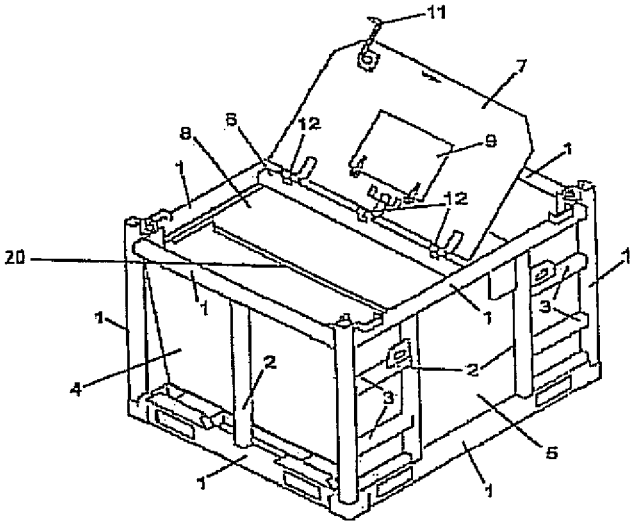
FIG. 3 shows a perspective view of the waste container, in which the so-called service hatch is shown in an open position and a sliding lid is partially open.

FIG. 2 shows the waste container 1 in a transport position with the service hatch 7 closed, and the sliding lid 8 closed. When the sliding lid 8 is in its closed position, a locking and lifting mechanism 16 may pull the sliding lid 8 in towards the bulkhead 4, where a gasket 20 arranged on an end portion of the lid 8 forms a seal between the sliding lid 8 and the bulkhead 4.

As the hatch 7 is pivoted into its closed position, the shaft 13 of the opening mechanism 15 will engage the winch system 14, making it possible to operate the sliding lid 8 and also open the hatch 7 again whenever necessary, independently of the position of the sliding lid 7, for inspection of the waste container 1. It may be an advantage if the opening mechanism 15 is mounted remotely from the sliding lid 8 as the lid 8 is operated manually when the waste container 1 is being emptied, by the sliding lid 8 being opened and the waste container 1 being turned until its contents slide out by means of gravity. It may also be an advantage to construct the opening mechanism 15 in such a way that a transmission between the winch system 14 and the toothed wheels 19 is provided, which makes it easier to open the sliding lid 8.

The invention claimed is:

1. A drilling-mud container having a plurality of plates with corresponding vertical profiles and horizontal profiles forming a frame, the drilling-mud container comprising:

a sliding lid with an open position and a closed position;

a sliding track wherein the sliding lid moves along the sliding track;

an opening mechanism having a toothed wheel wherein the opening mechanism moves the sliding lid;

a hinged service hatch spaced apart from the sliding lid and having an open position and a closed position;

a pitch rack connected to the sliding lid, the pitch rack having an end portion wherein the end portion is inclined in a direction of the toothed wheel and further wherein the end portion abuts against the toothed wheel when the sliding lid is in the closed position;

a locking and lifting mechanism connected to the sliding lid to move the sliding lid to form a seal between the sliding lid and one of the plurality of vertical profiles of the frame in the closed position of the sliding lid; and a gasket connected to the sliding lid wherein the gasket forms the seal in the closed position of the sliding lid.

2. The drilling-mud container of claim 1 further comprising:

a winch system connected by a drive chain to the toothed wheel which is rotatably mounted to the frame and is engaged with the pitch rack connected to the sliding lid.

3. The drilling-mud container of claim 1 further comprising:

an abutment portion connected to the frame wherein the abutment portion is a sliding rail which surrounds a side edge of the sliding lid.

4. The drilling-mud container of claim 2 wherein the winch system is fixed inside the frame and is connectable to a shaft which is supported in the hinged service hatch wherein the hinged service hatch has a handle.

5. A drilling-mud container having a plurality of plates with vertical and horizontal profiles forming a frame, the drilling-mud container comprising:

a sliding lid with an open position and a closed position;

a locking and lifting mechanism connected to the sliding lid wherein the locking and lifting mechanism is positioned to move the sliding lid to seal against the frame;

a sliding track wherein the sliding lid moves along the sliding track;

an opening mechanism having a toothed wheel wherein the opening mechanism moves the sliding lid;

a hinged service hatch having an open position and a closed position wherein the opening mechanism is operable with the hinged service hatch in the open position and in the closed position;

an abutment portion connected to the frame; and a pitch rack connected to the sliding lid, the pitch rack having an end portion wherein the end portion is inclined in a direction of the toothed wheel and further wherein the end portion abuts against the toothed wheel when the sliding lid is in the closed position causing the sliding lid to be displaced in a vertical direction and seal against the abutment portion wherein the opening mechanism is operable when the hinged service hatch is in the closed position.

* * * * *